US010821490B2

(12) United States Patent
Bieniek et al.

(10) Patent No.: US 10,821,490 B2
(45) Date of Patent: Nov. 3, 2020

(54) TOOL CHANGEOVER SYSTEM AND METHOD

(71) Applicant: SMS group GmbH, Duesseldorf (DE)

(72) Inventors: Juergen Bieniek, Moenchengladbach (DE); Markus Schaprian, Moenchengladbach (DE); Ralf Rode, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 713 days.

(21) Appl. No.: 15/386,789

(22) Filed: Dec. 21, 2016

(65) Prior Publication Data

US 2017/0100757 A1 Apr. 13, 2017

Related U.S. Application Data

(62) Division of application No. 14/618,166, filed on Feb. 10, 2015, now Pat. No. 9,975,159.

(30) Foreign Application Priority Data

Feb. 11, 2014 (DE) ..... 10 2014 001 738
Apr. 11, 2014 (DE) ..... 10 2014 005 331

(51) Int. Cl.
*B21B 31/12* (2006.01)
*B21B 31/10* (2006.01)
(Continued)

(52) U.S. Cl.
CPC ..... *B21B 31/12* (2013.01); *B21B 27/02* (2013.01); *B21B 27/03* (2013.01); *B21B 31/02* (2013.01);
(Continued)

(58) Field of Classification Search
CPC ..... B21B 31/02; B21B 31/08; B21B 31/10; B21B 31/103; B21B 31/106; B21B 31/12; B21D 37/14; B21D 37/147
See application file for complete search history.

(56) References Cited

U.S. PATENT DOCUMENTS 2,165,921 A * 7/1939 Duda ..... B21B 31/08 294/67.2
3,425,256 A 2/1969 McGoogan et al.
(Continued)

FOREIGN PATENT DOCUMENTS

CN 101147915 A 3/2008
CN 201120400 Y 9/2008
(Continued)

OTHER PUBLICATIONS

Translation; EP 2368647 A1, Kreisl et al. Sep. 28, 2011.*
(Continued)

*Primary Examiner* — Edward T Tolan
(74) *Attorney, Agent, or Firm* — Collard & Roe, P.C.

(57) ABSTRACT

To minimize the setup times in the case of a tool changeover on rolls, the movement sequences are separated into transverse movements and vertical movements using a tool changeover system and method for changeover of at least one tool disposed on a roll shaft in a working position. In one aspect, the tool changeover system includes a tool changeover rack, a vertical transport and a transverse transport. A drawing frame separate from the tool changeover rack can be transported transversely separately with reference to the tool changeover rack. The tool changeover rack has a device for connecting with the vertical transport and a tool accommodation for accommodating the tool. The drawing frame has a device for connecting with the transverse transport and a device for connecting with the tool.

7 Claims, 4 Drawing Sheets

(51) Int. Cl.

| | |
|---|---|
| ***B21B 27/03*** | (2006.01) |
| ***B21B 27/02*** | (2006.01) |
| ***B21B 31/02*** | (2006.01) |
| *B21H 1/20* | (2006.01) |

(52) U.S. Cl.
CPC ..... *B21B 31/103* (2013.01); *B21B 31/106* (2013.01); *B21H 1/20* (2013.01)

(56) References Cited

U.S. PATENT DOCUMENTS

| | | | | |
|---|---|---|---|---|
| 3,436,945 | A * | 4/1969 | Karnkowski | B21B 31/10 72/239 |
| 3,504,517 | A * | 4/1970 | Clement | B21B 31/10 72/239 |
| 3,566,498 | A * | 3/1971 | Kato et al. | B21B 31/10 72/239 |
| 3,593,555 | A | 7/1971 | Grosko | |
| 3,646,790 | A * | 3/1972 | Properzi | B21B 31/08 72/43 |
| 3,665,655 | A * | 5/1972 | Klein | B21B 28/02 451/334 |
| 4,026,136 | A * | 5/1977 | Pell | B21B 31/10 72/238 |
| 4,090,388 | A | 5/1978 | Pim | |
| 4,148,206 | A | 4/1979 | Meurer et al. | |
| 4,222,258 | A | 9/1980 | Field | |
| 4,251,180 | A * | 2/1981 | Hansen | B21B 31/103 414/560 |
| 4,653,304 | A | 3/1987 | Feldmann et al. | |
| 4,932,111 | A | 6/1990 | Kark | |
| 4,949,568 | A | 8/1990 | Poloni | |
| 5,600,988 | A | 2/1997 | Abbey, III et al. | |
| 5,735,788 | A | 4/1998 | Yasutake et al. | |
| 5,887,472 | A | 3/1999 | Abbey, III | |
| 6,098,439 | A | 8/2000 | Lecrivain | |
| 6,408,667 | B1 | 6/2002 | De Jesus, Jr. | |
| 7,010,952 | B2 | 3/2006 | Hoffmann et al. | |
| 7,168,280 | B2 | 1/2007 | Mark et al. | |
| 7,232,191 | B2 | 6/2007 | Lee et al. | |
| 8,365,566 | B2 | 2/2013 | Langer et al. | |
| 2002/0078728 | A1 | 6/2002 | Mukaigawa et al. | |
| 2005/0000263 | A1* | 1/2005 | Wittkopf | B21B 31/103 72/239 |
| 2007/0119223 | A1 | 5/2007 | Herdan | |
| 2007/0251284 | A1* | 11/2007 | Heimann | B21B 31/12 72/91 |
| 2016/0016214 | A1* | 1/2016 | Nespoli | B21D 37/147 72/239 |

FOREIGN PATENT DOCUMENTS

| | | | | |
|---|---|---|---|---|
| CN | 101815590 | A | 8/2010 | |
| DE | 969 977 | C | 8/1958 | |
| DE | 88 06 968 | U1 | 7/1988 | |
| DE | 196 33 668 | C1 | 11/1997 | |
| DE | 103 17 312 | A1 | 11/2004 | |
| DE | 10 2004 063 547 | B3 | 7/2006 | |
| DE | 10 2005 056 659 | A1 | 7/2006 | |
| DE | 10 2005 056 649 | B3 | 5/2007 | |
| EP | 0 163 104 | A2 | 12/1985 | |
| EP | 2 368 647 | A1 | 9/2011 | |
| JP | 52-103161 | A * | 8/1977 | B21B 31/08 |
| JP | 57-160505 | A * | 10/1982 | B21B 31/103 |
| JP | H06-47412 | A | 2/1994 | |
| JP | 2001-113307 | A | 4/2001 | |
| SU | 935145 | A1 | 6/1982 | |
| SU | 1069893 | A1 | 1/1984 | |
| SU | 1507475 | A1 | 9/1989 | |
| WO | 00/53350 | A1 | 9/2000 | |

OTHER PUBLICATIONS

Translation; JP 57-160505A, Katsushima et al., Oct. 2, 1982.*
German Office Action dated Nov. 25, 2014 in German Application No. 10 2014 005 331.8 with English translation of relevant parts.
Chinese Office Action dated Apr. 28, 2016 in Chinese Application No. 201510073836.9 with English translation of relevant parts.
European Office Action dated Sep. 30, 2015 in EP 15 00 0319.2 with English translation of relevant parts.

* cited by examiner

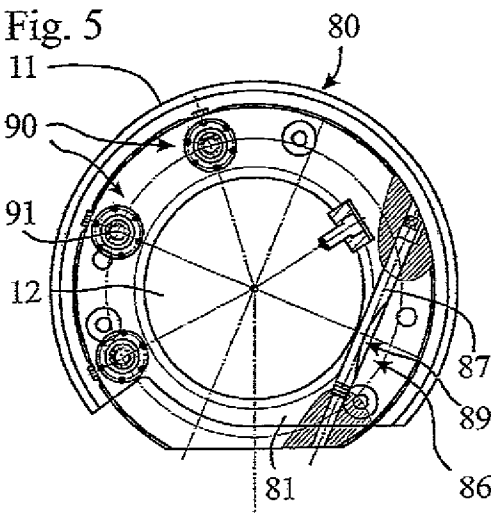
Fig. 5
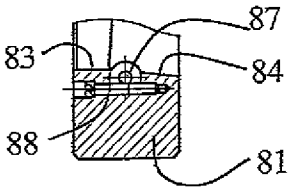
Fig. 6
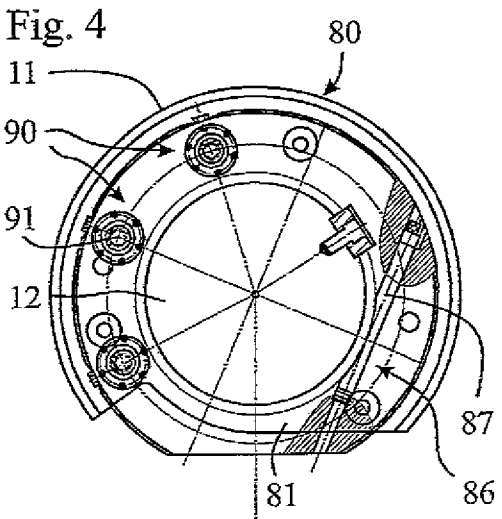
Fig. 4
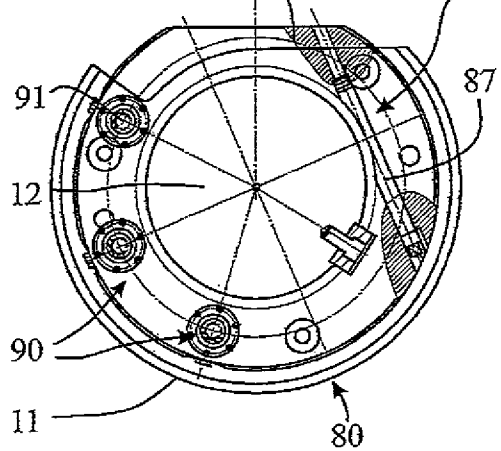
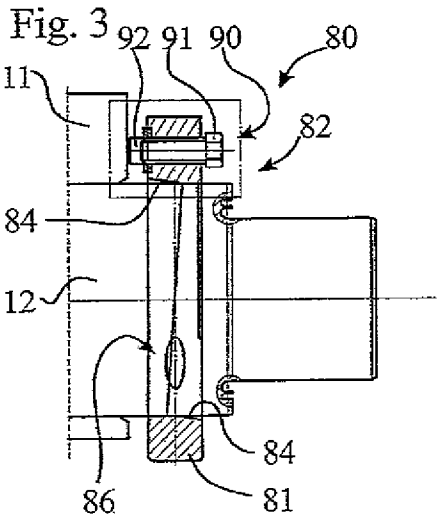
Fig. 3
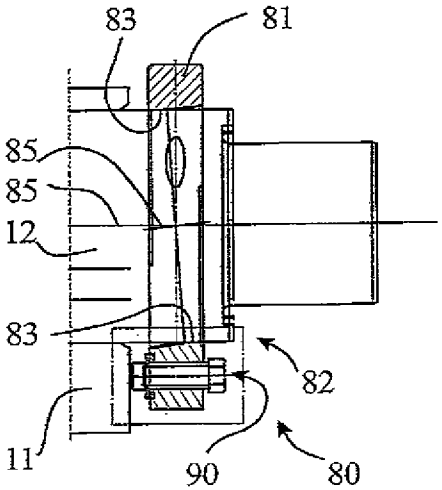

TOOL CHANGEOVER SYSTEM AND METHOD

CROSS REFERENCE TO RELATED APPLICATIONS

This application is a divisional of and Applicant claims priority under 35 U.S.C. §§ 120 and 121 of U.S. application Ser. No. 14/618,166 filed on Feb. 10, 2015, which Application claims priority under 35 U.S.C. § 119 of German Application Nos. 10 2014 001 738.9 and 10 2014 005 331.8 filed Feb. 11, 2014 and Apr. 11, 2014, respectively, the disclosures of which are incorporated by reference. Certified copies of priority German Patent Application No. 10 2014 001 738.9 and German Patent Application No. 10 2014 005 331.8 are contained in parent U.S. application Ser. No. 14/618,166.

BACKGROUND OF THE INVENTION

1. Field of the Invention

The invention relates to a tool changeover system and a tool changeover method.

2. Description of the Related Art

Corresponding tool changeover systems and methods are known for rolling machines and for stretching rolls and transverse rolls. For example, such systems and methods are known from EP 2 368 647 A1, DE 10 2005 056 649 B3, EP 0 163 104 A2, U.S. Pat. No. 5,600,988 or also DE 103 17 312 A1, in which pairs of rolls, in each instance, in particular, are mounted horizontally one on top of the other on two roll supports disposed on both sides of the pairs of rolls. Roll changeover systems and methods are also known from other documents, such as, for example, DE 196 33 668 C1, from DE 10 2004 063 547 B3, and from JP 6-47412 A, in which, however, significantly more complex rolling machines having a plurality of rolls are provided. In this connection, these arrangements, with the exception of DE 103 17 312 A1 and DE 10 2005 056 659 B3, rely on relatively complex configurations, in which a tool changeover rack allows both transverse transport and vertical transport of the roll to be changed over. Both DE 10 2005 056 649 B3 and DE 103 17 312 A1, in contrast, rely on making it possible to remove the rolls vertically, together or one after the other, from shaft stumps of the roll supports, or to put them back into position, but this capability requires significant structural effort and, in particular, permits retrofitting only with great difficulty.

Also, DE 88 06 968 U1 and U.S. Pat. No. 5,735,788 disclose tools disposed in a working position on a roll shaft of a roll and clamped by way of a clamping ring, and quick-clamp-and-release units, which can be clamped and released, in each instance, by way of activation elements that are relatively difficult to access.

SUMMARY OF THE INVENTION

It is an object of the present invention to make available tool changeover systems and tool changeover methods in which a tool changeover can be carried out quickly and in operationally reliable manner, and which can also be used, if necessary, in existing rolling machines.

These and other objects are accomplished by tool changeover systems and tool changeover methods having the characteristics according to the invention. Further advantageous embodiments, possibly also independent of these characteristics, are found below.

For example, a tool changeover system for changeover of at least one tool disposed on a roll shaft in a working position, comprising a tool changeover rack, a vertical transport, and a transverse transport, can be retrofitted and guarantees fast and operationally reliable tool changeover, if the tool changeover system comprises a drawing frame that is separate from the tool changeover rack and can be transported transversely separately with reference to the tool changeover rack, wherein the tool changeover rack has a device for connecting with the vertical transport and a tool accommodation for accommodating the tool, and the drawing frame has a device for connecting with the transverse transport and a device for connecting with the tool.

Such an arrangement relies on the separation between the transverse transport that starts from the drawing frame, which can be connected with the tool to be changed over, and the vertical transport that starts from the tool changeover rack and can accommodate the tools made available by way of the transverse transport in a tool accommodation and can make them available for changeover.

The tools to be changed over are modules that come into direct contact with the workpiece to be worked on when used as intended. As a result, the tools serve, for example, for stretch-rolling and/or transverse rolling for contouring and/or pre-forming the workpiece.

Accordingly, quick tool changeover, which can be carried out in operationally reliable manner, and can also be used in existing rolling machines, if applicable, takes place also via a tool changeover method for changeover of at least one tool disposed on a roll shaft in a working position, which shaft in turn is disposed in a roll stand. First, the tool is connected with a drawing frame to form a compound structure, and a transverse transport is connected with the drawing frame, and afterward, the tool, in combination with the drawing frame, is brought from its working position to a tool changeover rack or from the tool changeover rack to its working position.

The tool changeover rack can then be brought from and/or to a changeover position by means of the vertical transport; generally, this movement can already be easily guaranteed, in operationally reliable manner, using existing vertical transports.

The separation between vertical transport and transverse transport allows great flexibility in the specific embodiment of the tool changeover system, so that this system can be easily adapted to existing rolling machines or systems. In particular, it is easily possible to thereby carry out a corresponding tool changeover even in the case of more complex rolling machines or systems, if the related components, such as, for example, the transverse transport, the drawing frame, the tool changeover rack and the like are configured in suitable manner.

Preferably, if multiple tools are supposed to be changed over, the tools are connected to form a compound structure, while the changeover is carried out. In this manner, it is possible to change the composite tool structure over as a unit, together with the drawing frame, which is accordingly connected with the tools, and this feature saves time accordingly.

In this connection, it is conceivable to connect the tools with one another to form a compound structure, so that these tools can be removed, for example pulled off a roll shaft or a roll, particularly a central roll, or set on, for example pushed on, together. Likewise, the compound structure composed of tools can be implemented by way of the drawing frame, so that the drawing frame connects the corresponding tools and thereby a connection of the drawing frame with the tools is made available at the same time.

In this connection, it is understood that the compound structure composed of tools and drawing frame is not necessarily restricted to one roll and/or roll shaft. Instead, it is conceivable that the drawing frame can also connect tools with different rolls and/or roll shafts or can be connected with these rolls and/or roll shafts.

In the present case, a roll comprises a roll shaft having at least one tool disposed on the roll shaft, as this arrangement can be found, in particular, in the case of stretching rolls or transverse rolls. Particularly in the case of stretching rolls or transverse rolls, for example, because two rolls, in other words two roll shafts equipped with tools, interact, a distinction can be made between an upper and a lower roll shaft and therefore also between an upper and a lower roll.

In this regard, it can be possible that multiple compound structures of tools take place for changeover of the tools. These structures can take place in such a manner, for example, that two or more tools are connected with one another on a roll shaft. As a result, two or more tools are disposed on a roll shaft and connected to form a compound structure. It is also possible, however, to connect one or more tools that are disposed on an upper roll shaft with one or more tools that are disposed on a lower tool shaft, to form a compound structure. For example, the tools of the upper and lower roll shaft that lie on the outside, in each instance, can be connected with one another to form a compound structure. Any combination of compound structures is fundamentally possible.

It should be emphasized that the term "drawing frame" does not reduce the corresponding module to a mere drawing anchor. Instead, this frame can also be subjected to thrust stress and other bearing forces. If the stresses on the drawing frame are restricted to the transverse displacements of the tools or rolls, however, then the drawing frame can have a relatively light construction. This relatively light construction particularly facilitates handling of the drawing frame even when used in more complex structures within the rolling machine.

In contrast, the tool changeover rack can be configured to be significantly more stable and also for absorbing stresses in the case of vertical movements, because the tool changeover rack can be positioned more flexibly because of the separation between transverse transport and vertical transport, i.e. between a transverse and a vertical movement, so that its more stable structure does not become an obstacle.

A tool changeover that can be carried out quickly and in operationally reliable manner, and can also be used in existing rolling machines, if applicable, is also made possible via a tool changeover system for changeover of at least one tool disposed on a roll shaft in a working position, comprising a tool changeover rack, a vertical transport, and a changeover rack guide, wherein the changeover rack guide is configured as a motion link guide between the tool changeover rack and a guide support, if the motion link guide has a guide track that is open at the top and guides the tool changeover rack all the way to a changeover position, with reference to the working position, which track constantly comprises a vertical track component.

Here, too, the separation between transverse transport and vertical transport is implemented, because a corresponding vertical transport is easily able to introduce a corresponding tool changeover rack into the guide track from above and to lower it all the way to the changeover position, or, proceeding from the changeover position, to pick up the tool changeover rack out of this guide again. In this manner, the tool changeover rack can be brought into its changeover position quickly and in operationally reliable manner, without the use of a separate transverse transport being required.

These characteristics particularly hold true if an insertion aid is provided at a guide entrance of the guide track disposed in the region of the guide track opening. A guide track can also be referred to as a motion link track. Particularly by means of such an introduction aid, which can be implemented as a widened groove region of a guide groove, for example, a simple crane or an indoor crane that is already present in corresponding systems, in any case, or something similar can easily be used as a vertical transport. This embodiment has the resulting advantage that an existing crane, in general a large indoor crane, can be used in order to achieve a precise set-down position, in combination or interaction with the guide track.

It is understood that the motion link guide or the guide track can also have horizontal track components in addition to the constant vertical component that guarantees an operationally reliable movement sequence along the guide track, using only a vertical transport, with which components a specific movement track or guide track of the tool changeover rack can be forced to come about, as long as a vertical component is also present at the same time. This arrangement particularly allows simple adaptability of the corresponding tool changeover system or of the corresponding tool changeover method to different structural conditions, as they are found, in particular, in the case of retrofitting procedures.

Thus, in this way, the tool changeover rack can be horizontally displaced just before reaching the changeover position, for example, and can be brought closer to the rolls to be changed over. Likewise, structural conditions that might be present can be circumvented in this manner.

In this connection, it should be emphasized that the term "guide track" should be understood in abstract terms, because ultimately it is directed at the movement of the tool changeover frame with reference to locally fixed modules. In this regard, the corresponding motion link guide—and, accordingly, the related guide groove—need not be open at the top in order to implement a guide track that is open at the top, if, for example, the guide groove is provided on the tool changeover rack and a corresponding guide spring of the motion link guide is provided on the guide support. In the latter case, the motion link track would then be open toward the bottom, but would nevertheless lead to a guide groove that is open toward the top, because the tool changeover rack is guided freely above the guide and guided into the guide track when it is lowered.

Accordingly, a tool changeover that can be carried out quickly and in operationally reliable manner, and could also be used in existing rolling machines, if applicable, can be implemented via a tool changeover method for changeover of tools disposed on roll shafts in a working position, which in turn are disposed in a roll stand, if a tool changeover rack is moved away from a changeover position or moved to the changeover position along a guide track that guides the tool changeover rack with reference to the working position, and if the tool changeover rack is introduced into the guide track via a vertical transport and can be lowered from above all the way to the changeover position and/or is raised upward, proceeding from the changeover position, until it leaves the guide track. This method, too, relies on being able to bring the tool changeover rack all the way to its changeover position by means of the vertical transport, while a possible transverse movement is then implemented in another manner, with the tool changeover rack situated in its changeover position. Accordingly, here, too, a separation between vertical transport and horizontal or transverse transport is provided.

Preferably, the guide support is configured separately from a roll support in which the roll shafts are disposed. In this way, the guide support allows simpler and operationally reliable tool changeover while performing its guiding function, on the one hand, and on the other hand can be easily retrofitted. Accordingly, a tool changeover system for changeover of at least one tool disposed on a roll shaft in a working position is also advantageous, cumulatively or alternatively to the other characteristics of the present invention, comprising a tool changeover rack, a vertical transport, and a changeover rack guide, wherein the changeover rack guide is configured as a motion link guide between the tool changeover rack and a guide support, if the tool changeover system is characterized in that the guide support is configured separately from the roll support in which the rolls are disposed, in order to carry out a tool changeover quickly and in operationally reliable manner, and to also have it be used in existing rolling machines, if applicable.

As has already been explained above, a crane is a particular possibility as the vertical transport. This possibility has the advantage that corresponding cranes are regularly present in production facilities, with which cranes even very great loads can be carried. Particularly because of the separately provided guide supports, a crane can bring a tool changeover rack to the guide supports and thereby to the guide track in simple and operationally reliable manner, because these structures can easily be provided at the corresponding position and preferably with a guide track that is open at the top and with an introduction aid.

The transverse transport, in contrast, can be implemented in simple manner via a cable pull mechanism, for example, which can be set up as such, with its cable winch, even at a slight distance from the rolling machine, while the cable as such does not need much room and can be guided all the way to the drawing frame even under more complex structural conditions. In this connection, it is particularly advantageous if a deflection roller is provided for the cable, so that different movement directions can be implemented using the same cable pull mechanism. In particular, it is therefore possible to implement not only pulling tools off from roll shafts but also drawing tools onto roll shafts.

As was already indicated initially, such tool changeover systems or tool changeover methods are of particular importance in connection with transverse rolls or stretching rolls. Although in this situation two rolls merely interact with one another, the corresponding tools are nevertheless very heavy and therefore difficult to handle. Also, the roll supports must absorb relatively great rolling forces, so that these roll supports have a very compact and complicated construction, which in turn makes access to these rolls significantly more difficult.

These considerations particularly hold true for stretching rolls, in which the tools must be axially pulled off from the rolls and pushed onto them again, particularly if corresponding configured and complex changeover devices for changeover of the entire tool set are not already present. Accordingly, it is advantageous if the tools are displaced from the roll shafts to the tool changeover rack and from the tool changeover rack to the roll shafts axially relative to the roll axes. This advantage applies, if applicable, also for other rolls besides stretching rolls, of course, but is of significant importance particularly for stretching rolls.

Due to the separation of transverse transport and vertical transport, as has already been described above, the axial movement component can easily be implemented via the transverse transport, whereby it is possible, in the case of a suitable configuration, that the tools are merely displaced axially and therefore always supported against gravity either in the roll supports or on corresponding non-displaced roll components, on the one hand, or on tool accommodations of the tool changeover rack. Accordingly, the transverse transport can also be configured to be relatively light and easy to handle. Once the tools have been accommodated on the tool changeover rack, then the vertical transport, which can easily be designed for very great loads, can take over further transport.

In this connection, it should be mentioned that the vertical transport can certainly be designed also for transverse movements, as is usual for indoor cranes, for example. Its transverse displacement properties are waived, however, to a great extent, within the guide or the immediate vicinity of the rolling machine, because these properties are then implemented by the guide.

A quick tool changeover, which can easily be carried out even in existing rolling machines, can be implemented, cumulatively or alternatively, even independent of the other characteristics of the present invention, by a roll comprising a roll shaft and tools disposed on the roll shaft, in a working position, if the roll is characterized in that it comprises a clamping ring having a quick-clamp-and-release unit that clamps the tools.

Such a quick-clamp-and-release unit can particularly comprise a securing pin and/or a clamping screw. The securing pin preferably serves as an axial securing device; the clamping screw can particularly represent a clamping element.

Preferably, a securing element that is disposed on the clamping ring in non-releasable manner and can be moved from a securing position into a release position and back can serve as an axial securing device. This movement can be done, for example, via a corresponding rotation of the securing element or a corresponding axial displacement. If applicable, a tilt lever arrangement or something else can also be used, whereby a securing element that can be displaced by means of a rotational movement between its securing position and its release position proves to be particularly compact and easy to activate.

In particular, a groove or a similar recess can be provided on the roll shaft, into which the securing element engages in its securing position. Such a groove or recess can easily be introduced into a roll shaft after the fact. On the other hand, corresponding projections can also be affixed to the roll shaft or set onto the same, into which projections the securing element engages accordingly in its securing position, in order to implement axial securing in this manner.

The securing pin is preferably configured in such a manner that it can be activated by means of a simple rotation of 180°. As a result then, the clamping ring can be quickly secured on the roll shaft or released from it, by means of the simple rotation. For this purpose, the clamping ring has a recess that allows securing of the clamping ring on the roll shaft and removing the clamping ring from or setting it onto the roll shaft, via rotation of the securing pin. Using a securing pin, it is possible to secure the clamping ring on the roll shaft by a 180° rotation of the securing pin.

It is understood that the quick-clamp-and-release unit does not necessarily have to have a clamping screw as a clamping element. Instead, other clamping elements can also be provided, which have a corresponding axial effect. Preferably, these clamping elements comprise an activation element with which they are activated, in other words clamped or unclamped. Such an activation element can, accordingly, particularly be a screw head of a clamping screw. Preferably, the activation element is disposed axially on the outside, in other words facing away from the tools, so that it—in contrast to the roll arrangements disclosed in DE 88 06 968 U1 or in U.S. Pat. No. 5,735,788—is easily and relatively freely accessible. In this way, the setup times can be significantly minimized, because tools that work particularly quickly can be used for activation.

Preferably, the clamping element is oriented axially, in other words parallel to the axis of the respective roll, so that the corresponding clamping forces can act directly and without any further deflection, and the clamping element has a relatively uncomplicated construction.

The clamping screw preferably has a clamping head and a screw head. The clamping head applies clamping forces to the tools and the screw head serves for activation of the clamping screw. In particular, the clamping screw can be disposed in such a manner that the clamping head can be referred to as lying axially on the inside, facing the tools, and the screw head as lying axially on the outside, facing away from the tools. By means of this arrangement of the clamping screw, it is possible to set a corresponding tool, for example in the form of an impact wrench, onto the screw head of the clamping screw and to tighten the clamping screw. Therefore the clamping ring having such a quick-clamp-and-release unit allows significantly faster tool changeover than known solutions.

Such a clamping ring can be easily set onto the roll shaft and can then axially clamp the tools. Via the quick-clamp-and-release unit, the corresponding roll changeover can be significantly accelerated as compared with known arrangements. The ring shape of the clamping ring brings about the result that here, too, a separation between transverse displacement for pulling the clamping ring off and vertical displacement for then making a different clamping ring available can preferably be implemented. A corresponding clamping ring can also be easily retrofitted, because clamping devices are provided in corresponding positions in any case, which can be replaced by a corresponding clamping ring.

In one embodiment, the quick-clamp-and-release unit can comprise two inner contact regions for making contact with the roll in a clamped state, on ah inside of the clamping ring, which regions are disposed to lie opposite one another in the circumference direction but axially offset. If an axially unilateral force is exerted on a ring configured in this manner, which force is correspondingly adapted to the offset in terms of its direction and moment, the two inner contact regions are clamped. If the direction of this force is changed, the ring comes loose, because it can then give way to a corresponding moment.

Accordingly, it is advantageous if the quick-clamp-and-release unit comprises two release regions that are disposed, in each instance, to lie opposite one of the inner contact regions and adjacent to the other one of the inner contact regions, whereby the inside is set back outward relative to the adjacent inner contact region in the release regions. This arrangement allows release in structurally particularly simple manner when the axially acting clamping force lessens or is reversed.

A corresponding clamping ring can be made available in particularly structurally simple manner if the inside of the clamping ring is configured in the shape of a partial-cylinder mantle in the region of the inner contact regions and/or in the region of the clamping regions. In this way, corresponding partial-cylinder mantles can be made available in simple and precise manner via rotating machining processes.

Preferably, the axes of the partial cylinders that belong to the inner contact regions coincide with one another, so that the inner contact regions can be made in one work step. This arrangement can be implemented in simple manner accordingly, in terms of production technology.

In this connection, the radius of the related partial cylinder of these inner contact regions can be configured to match the radius of the related roll shaft of the roll. In this way, the clamping ring can lie against this roll shaft very well on the inside with its inner contact regions, and can form a corresponding force fit.

Accordingly, it is also advantageous if the axes of the partial cylinders belonging to the release regions coincide with one another, because this arrangement can also be implemented easily in terms of production technology.

A setback of the release regions can also be implemented structurally particularly easily, if the axes of the partial cylinders that belong to the inner contact regions and the axes of the partial cylinders that belong to the release regions intersect. In this manner, the clamping ring opens directly in the release regions.

Cumulatively or alternatively, the radii of the partial cylinders that belong to the release regions can be configured to be greater than those of the partial cylinders that belong to the inner contact regions, thereby also making it easily possible to guarantee a setback of the inside of the clamping ring in the region of the release regions, which can also be easily structurally implemented, particularly if the axes of the partial cylinders belonging to the regions, in each instance, intersect.

The clamping ring can comprise an axial securing device that acts with shape fit relative to the roll shaft, which element is disposed in an angle segment of 180° in the circumference direction. In the center of this segment the one of the two inner contact regions that lies axially closer to the tools than the other of the two inner contact regions is disposed. In this way, the axial securing device, which acts with shape fit, can precisely position the inner contact region that lies closer to the tools, particularly if no clamping is present, in order to also particularly prevent slipping during clamping. Depending on the concrete implementation, a corresponding shape fit can be implemented by means of a securing pin, for example, which engages into a groove on the roll.

Simple clamping can be implemented where the clamping ring comprises a clamping element that acts axially on one of the tools, which element is disposed in an angle segment of 180° in the circumference direction, in the center of which segment that one of the two inner contact regions is disposed that is axially at a greater distance from the tools than the other one of the two inner contact regions.

In this manner, the clamping force brought about axially by this clamping element brings about a reverse moment in the clamping ring, which moment presses the two inner contact regions against the surface of the roll shaft, in each instance, and thereby compels force fit or friction fit to occur.

Preferably, the axial securing device and the clamping element are disposed to lie opposite one another in the circumference direction of the clamping ring, whereby it is understood that in this connection, deviations of up to 90° can be applied without any significant impairment of effect.

In particular, it is understood that—if necessary—multiple clamping elements or axial securing devices can also be provided, distributed over the circumference.

It is understood that the characteristics of the solutions described above and in the claims can also be combined, if applicable, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly shown also in the attached drawing. The drawing shows:

FIG. 3 is a detail representation of two clamping rings for the arrangement according to FIGS. 1 and 2;

FIG. 4 shows the arrangement according to FIG. 3 in a top view, axial to the rollers, with the securing element released;

FIG. 5 shows a clamping ring according to FIGS. 3 and 4 with the securing element secured;

FIG. 6 is a detail view of the non-releasable securing device of the clamping rings according to FIGS. 3 and 4;

DETAILED DESCRIPTION OF PREFERRED EMBODIMENTS

Figure 1:
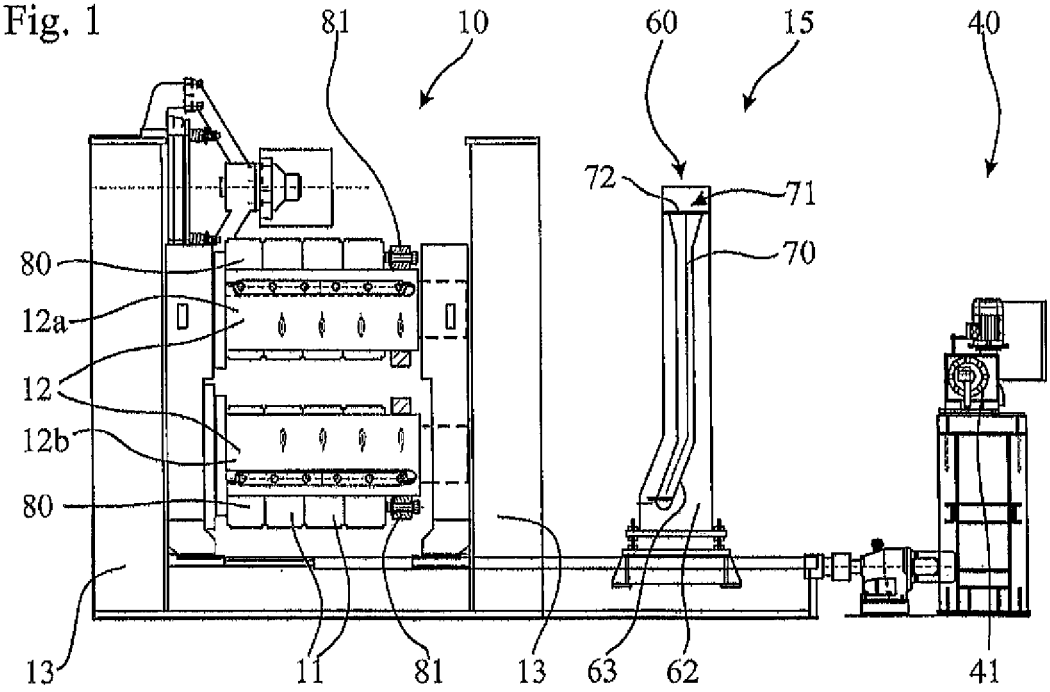
FIG. 1 is a schematic view of a rolling machine having a tool changeover system.

The rolling machine 10 shown in the figures comprises two rolls 80 disposed horizontally one on top of the other, which each comprise a roll shaft 12 and a plurality of tools 11 (numbered as an example) that are disposed on the respective roll shafts 12, and are used as stretching rolls in this exemplary embodiment. The upper roll shaft 12*a* (numbered in FIG. 1 as an example) is disposed above the lower roll shaft 12*b* (numbered in FIG. 1 as an example). The rolls 80 are mounted in roll supports 13, one of which is axially displaceable, and which absorb the forces that occur between the rolls 80 during the rolling processes.

Figure 10:
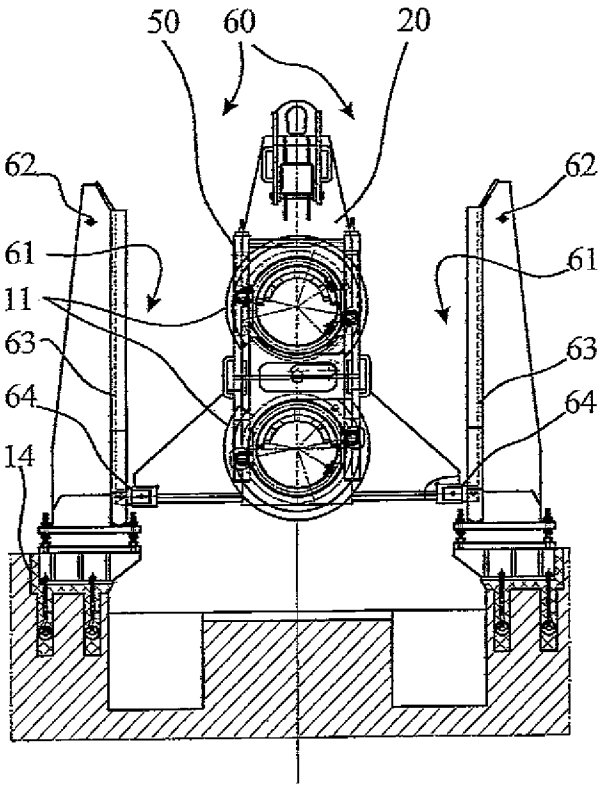
FIG. 10 shows a section through the arrangement according to FIG. 9.

The entire rolling machine 10 is disposed in a foundation 14 (see FIG. 10) of a production facility (not shown here).

The rolling machine 10 is provided with a tool changeover system 15 that can also be retrofitted, if applicable.

This tool changeover system 15 comprises a tool changeover rack 20 (see FIGS. 7 to 10), a vertical transport 30, a transverse transport 40, a drawing frame 50, and a changeover rack guide 60.

Figure 8:
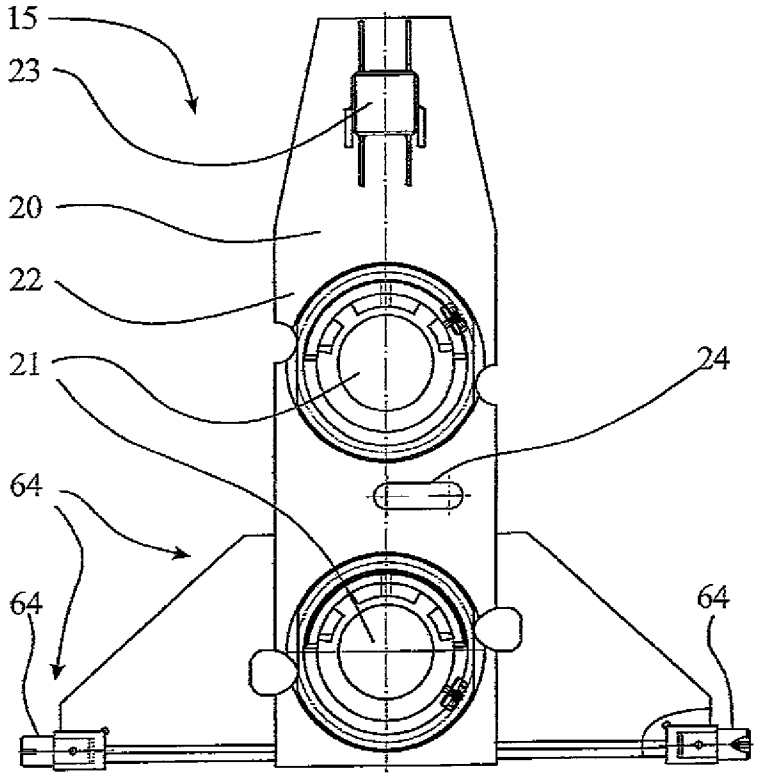
FIG. 8 is a front view of the tool changeover rack according to FIG. 7.
Figure 7:
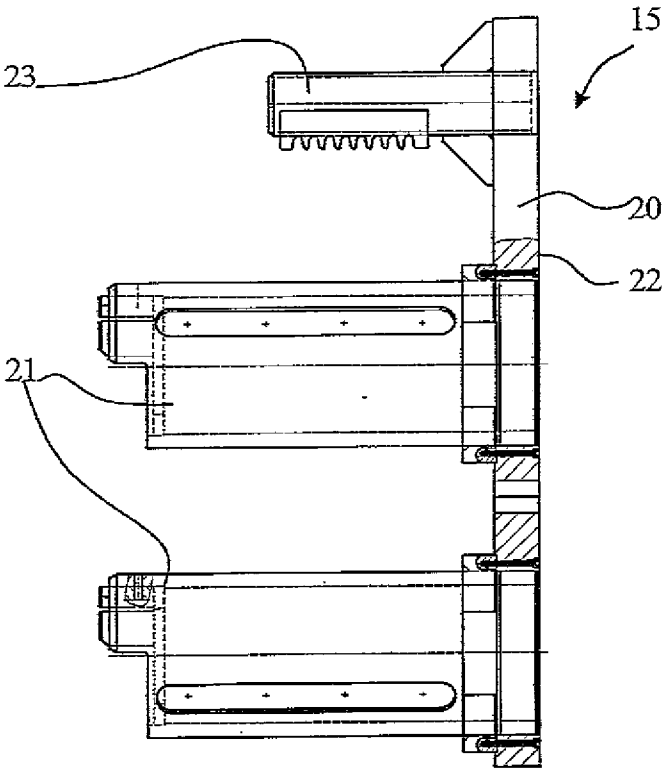
FIG. 7 is a side view of a tool changeover rack for the arrangement according to FIGS. 1 and 2.

As can particularly be seen in FIGS. 7 and 8, the tool changeover rack 20 comprises two tool accommodations 21, which are roll-shaped and are adapted to the inside working diameter of the tools 11 (FIGS. 9 and 10) with their outside diameter, and are attached to a main plate, vertically one on top of the other, wherein the position of the tool accommodations 21 on the main plate 22 corresponds to the position of the roll shafts 12 in the roll supports 13, to the greatest possible extent, so that the tool accommodations 21 can easily be positioned axially in front of the roll shafts 12, in order to take up the tools 11 in the case of a tool changeover, by means of a transverse movement, or, vice versa, to place them back onto the tool shafts.

Figure 9:
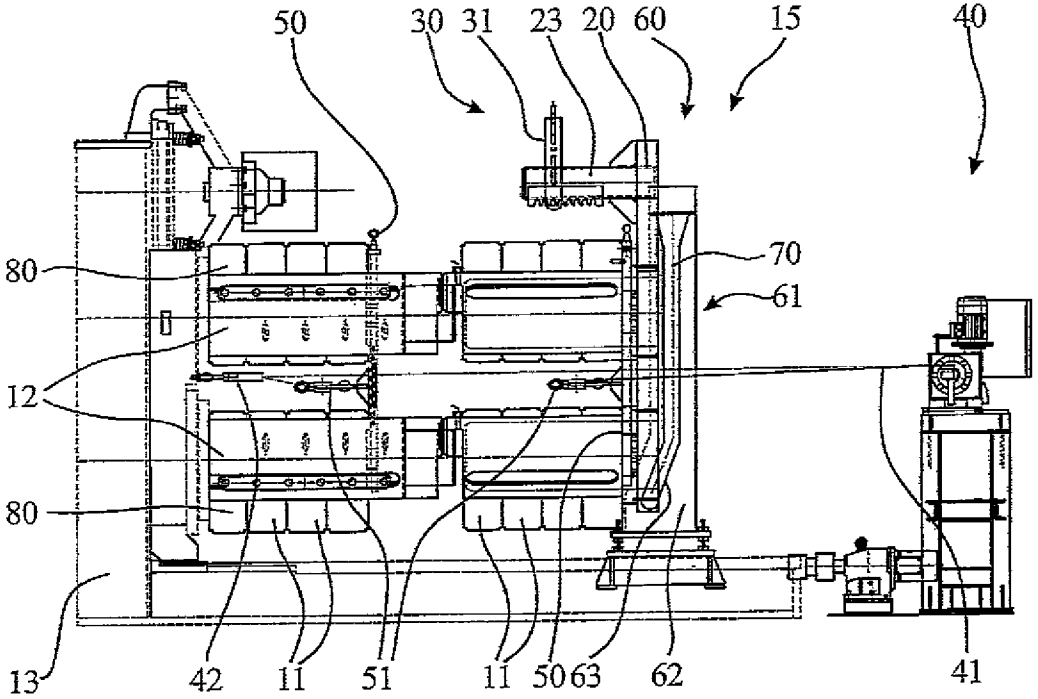
FIG. 9 shows the arrangement according to FIG. 2 with the tool changeover rack in place (roll stand not shown)

Furthermore, a hook continuation 23 is set onto the main plate 22, which continuation projects away from the main plate 22 essentially parallel to the tool accommodations 21 and carries a plurality of small recesses (not numbered), into which a crane hook 31 of an indoor crane (not shown) of the production facility can be hooked, as indicated in FIG. 9 as an example.

The plurality of recesses of the hook continuation 23 makes it possible to position the crane hook 31 axially differently, with reference to the center of gravity, because the center of gravity of this tool changeover rack 20 with or without tools 11 is certainly displaced with reference to the tools 11, and the question as to whether or not these tools are positioned on the tool accommodation 21 is certainly relevant.

It is understood that—depending on the concrete implementation—the tool changeover rack 20 can also be configured differently, particularly with regard to the placement of the tool accommodation 21 and of the hook continuation 23.

Furthermore, the tool changeover rack 20 has an opening 24 (FIG. 8) for a cable pull mechanism 41 (see, in particular, FIG. 9), which is used as the transverse transport 40 in this exemplary embodiment.

The transverse transport 40 furthermore comprises a deflection roller 42 for the cable pull mechanism 41, which can be introduced into the roll support 13 of the two roll supports 13 that is farthest away from the cable pull mechanism 41 (see FIG. 9). In this manner, the cable pull mechanism 41 can be used as a transverse transport 40 for different movement directions.

Furthermore, a tool securing device is disposed on the tool accommodations 21, which brings about securing in the circumference direction. Depending on the concrete embodiment of the rolls 80, other measures can also be provided.

The drawing frame 50 (see, in particular, FIGS. 9 and 10) is an essentially rectangular frame rack that has connection possibilities for the tools 11. In this connection, the tools 11 are also connected with one another to form a compound structure. It is understood that an alternative drawing frame 50 can also have connection elements for each individual tool, such as horizontal connection bars, for example, which are connected with the tools, in each instance, or are configured to reach, proceeding from the drawing frame 50, all the way to the tool 11 that is farthest away, in each instance, and then embrace all of the tools 11, in order to represent a compound structure composed of tools 11 and drawing frame 50 for the tool changeover, which structure then implements a corresponding tool changeover with a very small number of transverse movements or axial movements. Accordingly, it is not absolutely necessary that the tools 11 constantly form a compound structure with one another.

Furthermore, an attachment 51 for the transverse transport 40 or for the cable pull 41 is provided on the drawing frame 50, so that it can be quickly connected with the transverse transport 40 in operationally reliable manner. It is understood that—depending on the concrete embodiment—a different transverse transport can also be used in place of a cable pull 41.

The deflection roller 42 can be used for pushing the tools 11 onto the roll shafts 12, in that the cable pull 41 can be deflected by way of the deflection roller and thereby can be used to act by pulling in the direction of the roll shafts 12.

In order to position the tool changeover rack 20 into a changeover position quickly and in operationally reliable manner (see FIGS. 9 and 10), the changeover rack guide 60 has a motion link guide 61 in two guide supports 62, which are set up to the side of the opening path of the roll support 13 that is disposed closest to the guide support 62 and the cable pull 41. In this manner, the guide supports 62 can also be easily retrofitted, if applicable.

Each of the guide supports 62 has a guide groove 63 into which related guide springs 64 that are provided on the tool changeover rack 20 can engage in guiding manner.

In this connection, the motion link guides 61 define a guide track 70 for the tool changeover rack 20, which track is open at the top and has an introduction aid 72 (FIGS. 1 and 2) on its upper, open guide entrance 71, which aid is implemented by means of a widened region of the guide groove 63. It is understood that a corresponding guide track 70, which is open at the top and also has an introduction aid on its upper, open guide entrance 71 can also be implemented in a different manner. For this purpose, a motion link guide 61 is not absolutely necessary; in particular, a corresponding guide groove can also be provided on the tool changeover rack, which groove is configured to be open toward the bottom, in order to guarantee a guide track that is correspondingly open at the top.

Figure 2:
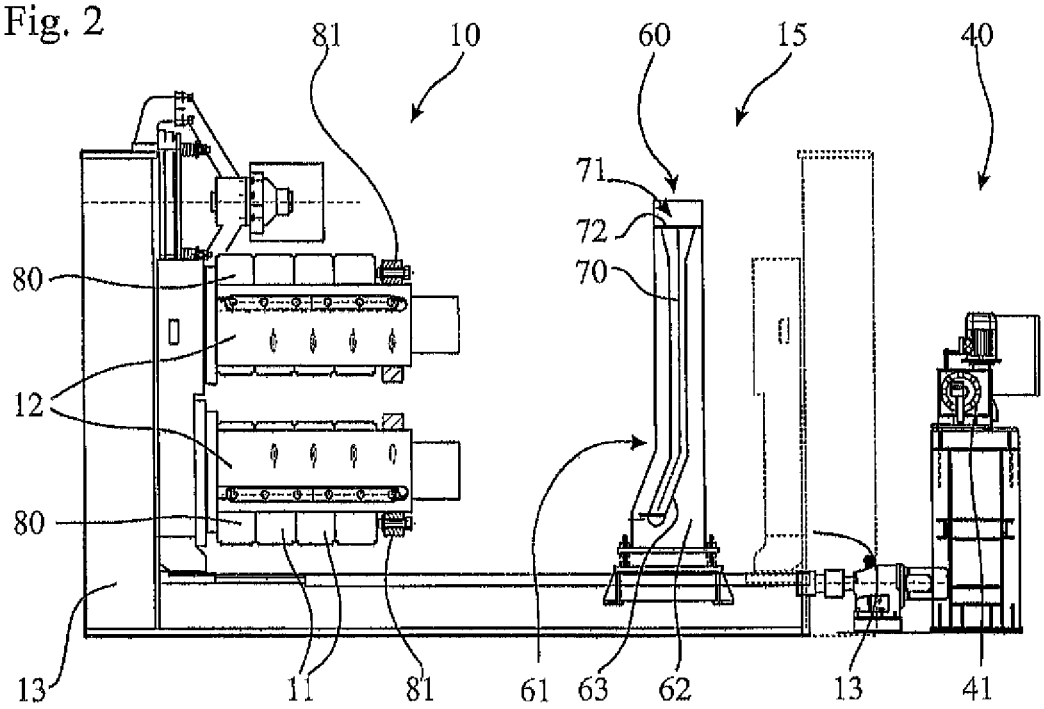
FIG. 2 shows the arrangement according to FIG. 1 with the roll stand open.

For a changeover of the tools 11, first the roll shafts 12 are moved into the changeover position and prepared. Then, the roll stand 13 that lies closest to the guide supports 62 is opened, as a comparison of FIGS. 1 and 2 shows.

In a next step, the drawing frame 50 is then screwed onto the tools 11, and thereby a corresponding compound structure is made available, which comprises all the tools 11 of the two roll shafts 12, in other words the tools 11 of the upper roll shaft 12*a* and of the lower roll shaft 12*b*, and the drawing frame 50.

Afterward, the tool changeover rack 20 is introduced into the guide tracks 70 with the crane, and lowered into its changeover position. As is directly evident, the guide track 70 has a vertical component in every position, so that corresponding lowering and subsequent lifting can easily be implemented.

Subsequently, the pulling cable of the Cable pull 41 is passed through the opening 24 and hooked into the attachment 51. The tools 11 can then be jointly pulled, as a compound structure—specifically by means of the drawing frame 50, also as a compound structure with the tools 11 of the two roll shafts 12—onto the tool accommodations 21, whereby in this exemplary embodiment, bridge elements are still set onto the roll shafts before this happens, in order to stabilize the movement sequence in this regard.

Thereafter, the crane hook 31 is moved, if necessary, in order to compensate for a change in the center of gravity of the tool changeover rack 20. Subsequently, the tool changeover rack 20 can be lifted using the crane and transported away. Then, a second tool changeover rack 20 with new tools 11 can be lowered into the guide track accordingly and brought into the changeover position. Now the deflection roller 42 is hooked into the roll support 13, the pulling cable of the cable pull 41 is laid into the deflection roller 42 and hooked into the attachment 51 on the back side of the drawing frame 40. Subsequently, the tools 11, as a compound structure with the drawing frame 50, can be pulled onto the roll shafts 12.

Now, the drawing frame 50 is disassembled and removed. The roll support 13 can be closed again, whereby afterward, the rolls 80 can be moved back into the rolling position.

The setup times for a tool changeover for rolls 80, as compared with conventional tool changeovers, can already be reduced by means of these measures, from up to several hours until now to less than one hour, without a cost-intensive fully automated solution that cannot be retrofitted, for changeover of complete tool packages, having to be used. In particular, handling of individual tools is also eliminated.

The setup time can furthermore be reduced to approximately half an hour by means of clamping rings 81 that are released and removed before the drawing frame is mounted on the tools 11, and are installed again after the drawing frame 50 is removed from the tools 11.

These clamping rings 81 (see, in particular, FIGS. 3 to 6), where FIGS. 3 and 4 are detail representations of the two rolls 80 in the rolling machine 10 (see FIGS. 1, 2, 9, and 10), comprise a quick-clamp-and-release unit 82, which is essentially implemented by means of a securing pin 87 as an axial securing device and a clamping screw 91. A clamping head 92 of the clamping screw 91 is directed axially inward, in other words facing the tools, so that the clamping screw 91 can be adjusted using simple tools, such as an impact wrench, for example tightened or released.

Each of the clamping rings 81 has an inner contact region 83, with which the clamping ring 81 lies against the respective roll shaft 12 in the clamped state. Furthermore, each clamping ring 81 has a release region 84 that is set back outward relative to the inner contact region 83 that lies next to it but is axially slightly offset.

If the axial clamping is now released, the clamping ring 81 can be tilted onto the release regions 84, thereby allowing easy installation and removal.

In a concrete implementation, the inner contact regions 83 and the release regions 84 are implemented by means of inner regions of the clamping ring 81 that are configured in the form of partial-cylinder mantles, in each instance, the axes 85 of which regions intersect, whereby the partial-cylinder mantle that belongs to the partial-cylinder mantle surfaces of the release regions 84 has a slightly greater radius than the partial-cylinder mantle that belongs to the two inner contact regions 83.

The axes 85 of these two cylinders intersect approximately in the center of the clamping ring 81 (see FIG. 3, bottom), so that the clamping ring 81 can also be produced by means of simple production techniques, which rely on rotating tools.

Furthermore, the clamping ring 81 has an axial securing device 86, which is implemented by means of a securing pin 87 oriented perpendicular to the common axis 85 of the roll shaft 12 and of the inner contact regions 83, which pin passes through the clamping ring 81 in a corresponding bore. This bore opens inward at a location (see FIG. 3), so that the securing pin 87 can engage into a groove, not shown, of the roll shaft 12, in order to axially secure the clamping ring 81 in this way. The securing pin 87 is furthermore secured to prevent it from coming loose, by way of a securing screw 88 (see FIG. 6).

This non-releasable securing of the securing pin 87 takes place in such a manner, however, that the securing pin 87 can still be rotated in its bore, so that a recess 89 of the securing pin can be rotated to secure or release the axial securing device 86 accordingly. When the recess 89 faces the roll shaft 12 or the groove of the roll shaft 12, the clamping ring 81 can be removed, because the axial shape fit between the securing pin 87 and the groove is opened, while the axial securing device 86 engages when the recess faces away from the roll shaft 12 and therefore the shape fit between roll shaft 12 and securing pin 87 is closed.

Furthermore, the clamping ring 81 comprises a clamping element 90 that can apply a clamping force coaxial to the axis 85 of the roll shaft 12. The clamping element 90 comprises a clamping screw 91, by means of which a clamping head 92 can be axially clamped against an adjacent tool 11. In this connection, at least two of the clamping elements 90 sit in an angle segment of 180°, which comprises that inner contact region 83 that lies farthest away from the tool 11 that lies next to the clamping ring 81, in its center. In this manner, the clamping force applied axially by means of the clamping element 90 leads to a tilting moment that presses the two inner contact regions 83 against the roll 12.

The clamping elements 90 are disposed to lie opposite one another in the circumference direction the axial securing device 86, so that the axial securing device 86 is disposed in an angle segment of 180°, which comprises that inner contact region 83 that lies closest to the tool 11 that lies next to the clamping ring 81, in its center.

The clamping ring 81 with its quick-clamp-and-release unit 82 can be installed and removed extremely quickly, thereby making it possible to further reduce setup times. Furthermore, it can also be used for existing rolls 80 and can be set onto and removed from the roll shafts in separate transverse and vertical movements, accordingly.

Although only a few embodiments of the present invention have been shown and described, it is to be understood that many changes and modifications may be made thereunto without departing from the spirit and scope of the invention.

What is claimed is:

1. A tool changeover system used in a rolling machine for changeover of at least one tool comprising a roller disposed on a roll shaft in a working position in the rolling machine comprising:

(a) a vertical transport;

(b) a tool changeover rack;

(c) a guide support; and (d) a changeover rack guide configured as a motion link guide between the tool changeover rack and the guide support, wherein the motion link guide comprises a guide track having an open top portion comprising a guide track opening, and wherein the guide track comprises a constant vertical track component guiding the tool changeover rack to a changeover position with reference to the working position.

2. The tool changeover system according to claim 1, further comprising an introduction aid provided on a guide entrance of the guide track disposed near the guide track opening.

3. The tool changeover system according to claim 1, wherein the tool changeover system serves for changeover of multiple tools disposed on different roll shafts and connected with one another to form a compound structure.

4. The tool changeover system according to claim 1, wherein the vertical transport is a crane.

5. A tool changeover system used in a rolling machine for changeover of at least one tool comprising a roller disposed in a working position on a roll shaft in a roll support of the rolling machine comprising:

(a) a vertical transport;

(b) a tool changeover rack;

(c) a guide support configured separately from the roll support; and (d) a changeover rack guide configured as a motion link guide between the tool changeover rack and the guide support;

wherein the motion link guide comprises a guide track having an open top portion and wherein the guide track comprises a constant vertical track component guiding the tool changeover rack to a changeover position with reference to the working position.

6. A tool changeover method used in a rolling machine for changeover of at least one tool comprising a roller disposed in a working position on a roll shaft in a roll stand of the rolling machine comprising the steps of:

(a) using a vertical transport to introduce a tool changeover rack into a guide track comprising a constant vertical track component guiding the tool changeover rack to a changeover position with reference to the working position; and (b) moving the tool changeover rack away from the changeover position or to the changeover position along the guide track;

wherein the tool changeover rack is lowerable from above the guide track into the changeover position or the tool changeover rack is raisable upward from the changeover position until the tool changeover rack leaves the guide track; and wherein the tool changeover method serves for changeover of multiple rolls disposed on different roll shafts and connected with one another to form a compound structure for a tool changeover.

7. The tool changeover method according to claim 6, wherein the tools are axially displaced from the roll shafts to the tool changeover rack and from the tool changeover rack to the roll shafts.

* * * * *